United States Patent [19]

Williams

[11] 4,248,755

[45] Feb. 3, 1981

[54] COMPOSITION AND METHOD FOR SIZING TEXTILES

[75] Inventor: Charles R. Williams, Saint Louis County, Mo.

[73] Assignee: Monsanto Company, St. Louis, Mo.

[21] Appl. No.: 75,433

[22] Filed: Sep. 14, 1979

Related U.S. Application Data

[60] Continuation of Ser. No. 348,435, Apr. 5, 1973, Pat. No. 4,189,416, which is a continuation-in-part of Ser. No. 92,915, Nov. 25, 1980, abandoned, which is a division of Ser. No. 885,319, Sep. 4, 1969, Pat. No. 3,585,070, which is a continuation-in-part of Ser. No. 755,726, Aug. 27, 1968, abandoned.

[51] Int. Cl.[3] ..... C08L 35/06

[52] U.S. Cl. ..... 260/29.6 TA; 260/29.6 H; 260/29.6 MN; 427/331; 427/412

[58] Field of Search ..... 260/29.6 H, 29.6 MN, 260/29.6 TA; 427/331, 412

[56] References Cited

U.S. PATENT DOCUMENTS

| | | | |
|---|---|---|---|
| 2,469,407 | 5/1949 | Powers et al. | 260/29.6 N |
| 2,519,764 | 8/1950 | Jacobson | 428/285 |
| 2,717,247 | 9/1955 | Contois | 525/328 |
| 2,723,195 | 11/1955 | Blake | 162/168 R |
| 2,757,153 | 7/1956 | Bowen | 260/29.6 N |
| 2,864,808 | 12/1958 | Harris | 260/29.6 TA |
| 3,030,342 | 4/1962 | Tiefenthal et al. | 525/369 |
| 3,585,070 | 6/1971 | Williams | 260/29.6 MN X |
| 3,630,983 | 12/1971 | Pangle et al. | 260/29.6 MN X |

*Primary Examiner*—Lucille M. Phynes

*Attorney, Agent, or Firm*—R. Bruce Blance; William J. Farrington; Edward P. Grattan

[57] ABSTRACT

Disclosed herein is a composition and method for sizing textiles which employs as the sizing agent a mixed salt comprising the reaction product of an interpolymer with a fixed alkali base and a fugitive alkali base; the latter subsequently being volatilized away during processing of the sized textile. The interpolymer comprises (a) 1.0 molar proportion of a maleic or fumaric acid or anhydride or partial ester, (b) from 0.1 to 3.0 molar proportion of a monovinylidene aromatic monomer and (c) from zero to a finite molar proportion of an alpha-olefin, a vinyl ester, alpha-beta-ethylenically unsaturated nitrile, an acrylic or methacrylic ester or a vinyl alkyl ether. From 10 to 70% of the free carboxyl groups of the interpolymer are combined with fixed base, i.e., non-valatile amine or alkali metal base, and from 5 to 90% of said free carboxyl groups are combined with fugitive base, i.e., ammonia, ammonium hydroxide or volatile amine.

5 Claims, 1 Drawing Figure

COMPOSITION AND METHOD FOR SIZING TEXTILES

BACKGROUND OF THE INVENTION

1. Related Applications

This is a continuation of application Ser. No. 348,435 filed Apr. 5, 1973, now U.S. Pat. No. 4,189,416, which is a continuation-in-part of application Ser. No. 92,915, filed Nov. 25, 1980, now abandoned, which is a division of copending application Ser. No. 855,319, filed Sept. 4, 1969, now U.S. Pat. No. 3,585,070, which in turn is a continuation-in-part of application Ser. No. 755,726 filed Aug. 27, 1968, and now abandoned.

2. Field of the Invention

This invention relates to improved textile treating compositions.

3. Description of the Prior Art

In commercial textile weaving operations, the breakage of individual warp fibers has long been a costly problem. When breakage occurs, the loom automatically stops and the fractured strand must be tied or spliced by hand before the process can continue. These "warp stops" can be decreased by coating the warp threads with sizes which improve abrasion resistance and add tensile strength to the fibers. It has been found, however, that yarns treated with many of the sizes of the prior art lose a substantial part of the size film when subjected to the friction and abrasion concomitant with the weaving operation. When this dusting is excessive, as often happens, the warps lose their stiffness character and weaving efficiency is adversely affected.

It has also been common practice to treat fabrics and yarns which are to be woven as warps with aqueous solutions of an adhesive or binding substance in order to impart a relatively stiffened finish thereto. Starch, modified starch products, e.g., thin boiling starch, soluble starch, and dextrin; natural gums, e.g., locust bean gum and gum arabic or animal or vegetable proteins, e.g., glue gelatin, casein, soy bean and peanut protein have been employed. Fabrics and yarns so treated, however, tend to lose their stiffened character and appearance after a single washing and also tend to dust out.

It is known that many of these deficiencies can be overcome by the use as the sizing agent of an interpolymer of styrene and maleic anhydride. It is also known that the physical properties of such interpolymers are improved as the molecular weight of the interpolymer is increased. In particular, the alkali metal salts of high molecular weight styrene maleic anhydride copolymers, i.e., having a molecular weight in a range equivalent to a specific viscosity of about 2 to 8 (0.5 grams per 100 ml. of dimethyl formamide at 25° C.). Such salts, however, have not been used commercially for the following reasons. For example, alkali metal salts of styrene maleic anhydride copolymers are highly hygroscopic and lose strength and become tacky in humid surroundings. Further, and even more important, solutions of high molecular weight styrene maleic anhydride resins have unworkable aqueous size bath viscosities at the solids levels required for adequate size performance. It is known that the aqueous styrene maleic anhydride size solution viscosity may be reduced to workable levels by increasing the content of the alkali metal salt. However, when this is done the water sensitivity mentioned above is increased and poor sizing efficiency results. Attempts have been made to overcome the water sensitivity problem by employing the ammonium or volatile amine salts of styrene maleic anhydride copolymers in place of the alkali metal salts. Upon drying, however, these salts lose ammonia or amine and become excessively brittle. They are also difficult to remove from dry sized yarn in aqueous washing solutions, in applications where such removal is desirable.

A need, therefore, exists in the industry for a textile size and a method for applying it wherein water sensitivity, brittleness upon drying, and bath viscosity are minimized without sacrificing other physical properties necessary for an effective size.

SUMMARY OF THE INVENTION

The present invention relates to treating yarns and fabrics with a warp size comprising a mixed salt of an interpolymer such as styrene/maleic anhydride.

In particular, this invention relates to a textile material sizing and finishing composition which comprises an aqueous solution of a mixed salt of an interpolymer; wherein said interpolymer comprises:

(a) 1.0 molar proportion of at least one carboxylic monomer selected from the group consisting of maleic anhydride, maleic acid, fumaric acid, and partial esters of up to the 100% half-ester of maleic or fumaric acid with monohydric alcohols of from 1 to 8 carbon atoms.

(b) from 0.1 to 3.0 molar proportion of at least one monovinylidene aromatic monomer containing from 8 to 12 carbon atoms, and (c) from zero to X molar proportion of at least one monomer selected from the group consisting of alpha-olefins of up to 8 carbon atoms wherein X is 2, vinyl esters of from 1 to 4 carbon atoms in the acyl group wherein X is 8, alpha-beta-ethylenically unsaturated nitriles wherein X=2, acrylic and methacrylic esters of from 1 to 8 carbon atoms in the alkyl group wherein X is 0–5 and vinyl alkyl ethers of from 1 to 4 carbon atoms in thealkyl group wherein X is 6;

the total of monomers (b) and (c) being at least 1.0 molar proportion; and wherein (a′) from 10 to 70% of the free carboxyl groups of said interpolymer are combined with at least one fixed base selected from the group consisting of non-volatile monobasic amines and alkali metal bases, and (b′) from 5 to 90% of the free carboxyl groups of said interpolymer are combined with at least one fugitive base selected from the group consisting of ammonia, ammonium hydroxide and volatile monobasic amines, such that a total of from 20 to 100% of said free carboxyl groups are so combined. The solution is applied in an amount sufficient to provide about 0.5 to about 20 weight percent of the salt based on the weight of the yarn. The treated textile materials are heated at a temperature high enough to volatilize the fugitive base. Advantageously this heating may be accomplished during the drying operation. As used herein, the term "textile materials" is intended to include fibers; monofilament, multifilament and spun yarns; and woven fabrics.

DESCRIPTION OF THE PREFERRED EMBODIMENTS

Figure 1:
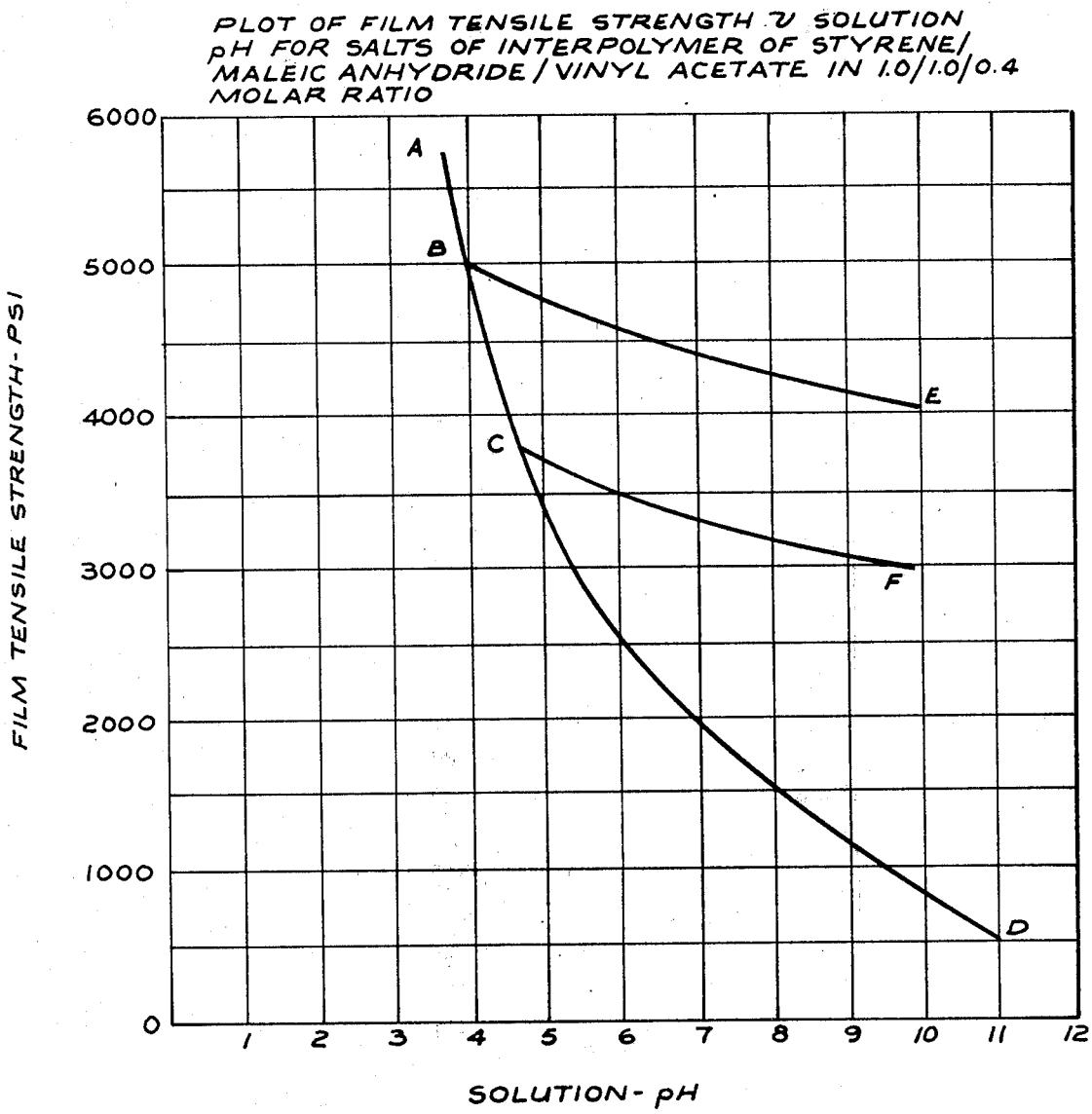

The interpolymer used in accordance with this invention may be prepared in several ways. One of the well known methods is mass polymerization which involves heating the monomeric mixture at temperatures between about 100° and 300° F. for several hours or more. Preferably, the materials are heated cautiously, as in a water bath. Another method which may be used is known as the solution process which involves reacting the monomeric mixture at slightly elevated temperatures in the presence of a solvent which is capable of dissolving both the starting materials and the finished polymer, e.g., acetone. If desired, the interpolymerization may be carried out in the presence of a catalyst, such as benzoyl peroxide. Still another method which can be used is the solvent/non-solvent method which involves carrying out the reaction as above but in a solvent which is capable of dissolving only the starting material and not the final copolymer.

The interpolymers produced by the above or by any other well known method of manufacture are generally insoluble in water as well as in alcohol or benzene, and form water-soluble salts of ammonia, amines or alkali metals.

Suitable monovinylidene aromatic monomers include, for example, styrene, alpha-methyl styrene, alpha-halo styrenes such as alpha-chloro styrene, etc., ring substituted alkyl and/or halo styrenes such as 2,4-dimethyl styrene, 2-methyl, 4-chloro styrenes, para-isobutyl styrene, etc.

Suitable carboxylic monomers include, for example, maleic acid or its anhydride, fumaric acid and the partial esters of up to the 100% half-ester of maleic or fumaric acid with a 1 to 8 carbon alcohol or ether alcohol such as, for example, methanol, normal or iso butanol, isopropanol, 2-ethylhexyl alcohol, monobutyl ether of ethylene glycol (i.e., butyl cellosolve), etc. To those skilled in the art, the term 100% half-ester signifies, in terms of dicarboxylic acids such as these, that up to 50% of the total carboxylic groups are esterified; that is, that the full half-ester has been formed.

The third, and optional, comonomer may be an alpha-olefin of up to 8 carbon atoms such as, for example, ethylene, propylene, butylene, octene, etc; a vinyl ester of from 1 to 4 carbon atoms in the acyl groups such as, for example, vinyl formate, vinyl acetate; vinyl propionate, vinyl butyrate, etc.; an alpha,beta-ethylenically unsaturated nitrile such as, for example, acrylonitrile, methacrylonitrile, etc.; an acrylic or methacrylic ester of from 1 to 8 carbon atoms in the alkyl group such as, for example, butyl acrylate, methyl methacrylate, 2-ethylhexyl methacrylate, etc.; and vinyl alkyl ethers of from 1 to 4 carbon atoms in the alkyl group such as, for example, vinyl methyl ether, vinyl ethyl ether, vinyl isobutyl ether, etc.

The carboxylic monomer units employed herein generally will not polymerize with themselves to any significant degree. Thus, it is necessary that at least 1.0 total moles of comonomers be provided for each mole of carboxylic monomer. In the case of styrene maleic anhydride copolymers, from 1.0 to 1.4 moles of styrene (i.e, monovinylidene aromatic monomer) are preferred. However, when one or more of the optional comonomers are present, the monovinylidene aromatic monomer proportion can be decreased to as low as 0.1 mole per mole of carboxylic monomer, provided sufficient of such optional monomer is added. The proportion of such optional comonomer present varies with the type of comonomer, All of those specified lend advantageous properties as is known to those skilled in the art. The upper molar proportions for each type of comonomer are chosen so as to represent the range of interpolymers suitable for textile treatment and to which the mixed salt (i.e., fixed/fugitive) concept of this invetion is applicable.

It is critical to the present invention that the interpolymer employed as the textile size be in the form of a mixed salt containing a fixed salt moiety and a fugitive salt moiety. For the purposes of this invention, a "fixed salt" is one derived by the neutralization of the acid groups of the interpolymer with bases containing an alkali metal cation or a non-volatile amine and a "fugitive salt" is defined as one derived by the neutralization of the acid groups of the interpolymer with ammonia, an ammonium base or a volatile amine. Further, for the purposes of this invention, a volatile amine is defined as one which will be substantially volatilized under the process conditions employed, most notably the drying step. Conversely, by non-volatile amine is meant one which will not be volatilized to any appreciable extent under the process operating conditions.

For the formation of the fixed salt of this invention, any basic compound containing an alkali metal cation may be employed. Exemplary thereof are lithium, sodium, potassium, rubidium, and cesium, hydroxides, carbonates, bicarbonates, etc.

Any monobasic amine which is non-volatile under the conditions of the process described herein may be employed in the formation of the fixed salt of this invention. Amines which would be non-volatile under most conditions likely to be employed are those amines with boiling points above 100° C. such as tri-n-propyl amine, n-hexyl amine, laurylamine, ethanol amine, diethanol amine, triethanol amine, 2-amino-2-methyl propanol-1, benzylamine, dicyclohexyl amine, aniline, toluidine, diphenylamine and the like.

From 10 to 70% of the free carboxyl groups of said interpolymer are combined as the fixed salt. At below 10%, or more preferably 30%, fixed salt the composition is insufficiently plasticized and lacks the required moisture absorption necessary to a proper size. Moreover, eventual removability of the size is poor. At above 70%, or more preferably 60%, fixed salt the physical properties deteriorate, e.g., poor tensile and too hydrophilic. In terms of styrene maleic anhydride copolymers, 40 to 50% fixed salt is most preferred.

Monobasic amines which would be volatile under ordinary process conditions and which thus may be used in the formation of fugitive salts of this invention are those with boiling points below 100° C. such as methylamine, dimethylamine, trimethylamine, ethylamine, diethylamine, triethylamine, n-propyl amine, n-butyl amine, and the like The proportion of fugitive salt is not as critical as is the fixed salt proportion. It is the fixed salt proportion which lends the physical properties to the sized textile. The function of the fugitive salt proportion is to adjust the working viscosity of the treating solution down to satisfactory levels. Once in place on the textile, the fugitive base is volatilized and, except for possible slight degree of amide formation the size becomes substantially the fixed salt. Thus, the only limitations on fugitive base are those established by viscosity requirements such that as little as 5% of free carboxyl groups reacted therewith provides measurable results. Up to 90% of such free radical groups, i.e., all those remaining after combination with fixed base, may be so combined. In many instances, particularly when employing ammonia, an excess thereof may advantageously be employed.

For the purposes of this invention, however, at least 20% and up to 100%, of the free carboxyl groups of the interpolymer are combined with fixed and fugitive bases taken together. The precise lower limit of total neutralization is such that for any given interpolymer the mixed salt will be soluble in the aqueous treating media. In the case of styrene maleic anhydride copolymers, from 40 to 100% total neutralization of free carboxyl groups with fixed and fugitive bases is preferred.

In carrying out the process of this invention the yarn or fabric is treated, as by dipping or spraying, with an aqueous solution or dispersion of the fixed salt; for example, in sizing warp yarns on a conventional slasher. The concentration of the mixed salt solution and the pickup should be adjusted to deposit on the yarn or fabric from about 0.5 to about 20 weight percent of the salt based on the weight of the substrate. It is preferred that the concentration be adjusted to deposit from 2 to 15 percent of the mixed salt and more preferably, between about 4 to 7 percent.

It is customary to apply the sizing or finishing materials described herein to yarns or fabrics. However, it is possible to obtain similar results by treating fibers, either initially or at any stage of their processing prior to spinning, after which the fibers may be spun and woven to obtain fabrics of desirable finish characteristics. Yarns prepared from such treated fibers may also be woven. It is also possible to employ the mixed-salt resin of this invention as binders for fibers which are to be used as such, as for example, in cotton batting, or in the preparation of non-woven fabrics. The process of this invention may be employed with any of a wide variety of yarns or fabrics, for example, cotton, viscose rayon, acetate rayon, nylon, glass, linen, flax, hemp, jute, ramie, wool, silk, cuprammonium rayon, polyacrylonitrile, polyesters, polyolefins and the like.

The process of this invention is operable with interpolymers of any molecular weight. However, as discussed above, the physical properties of a textile size are improved with increasing molecular weight. Thus, in terms of styrene maleic anhydride copolymers, it is preferred that the copolymers have a molecular weight in a range having a specific viscosity of from about 2 to 8, and more preferably from about 3 to 5 (as measured by 0.5 grams per 100 ml. of dimethyl formamide at 25° C.).

A further understanding of the sizing process and sized yarns of this invention will be obtained from the following specific examples which are intended to illustrate the present invention, but not to limit the scope thereof, parts and percentages being by weight unless otherwise specified. In each instance where a molar proportion of interpolymer is specified, it refers to the carboxylic monomer portion thereof.

EXAMPLE 1

One mole of a 1/1 copolymer of styrene and maleic anhydride is slurried in water. To the slurry is added one mole (i.e., 50% neutralization) of sodium hydroxide whereby the copolymer is dissolved yielding a solution containing 4.7% solids and having a pH of 6.7. The solution (Solution A) has a viscosity of 14,000 centipoises at 89° C., a viscosity much too high for use as a textile size. Sufficient concentrated ammonium hydroxyde (29% $NH_3$) is added to a portion of this solution to increase the pH to 7.5 (i.e. 7.5% neutralization to a total of 57.5% neutralization). Since a very small amount of ammonia is used, the solids content of the solution (Solution B) is still essentially 4.7%. The viscosity decreases markedly and is found to be 3450 centipoises at 65° C. Films of Solution A and Solution B are cast and permitted to dry at room temperature. During the drying, the odor of ammonia being emitted from Solution B is apparent. When dry the tensile strength of a film prepared from the sodium salt of this example is 3050 p.s.i. at 72% R.H. and 20° C. The tensile strength of the mixed salt prepared in this example is 3160 p.s.i. under the same conditions.

Textile yarn (warp 5900 ends of 65/35 polyester/cotton yarn 30/1) is sized with the mixed salt sizing solution prepared above and is run on a commercial 9 can slasher having an internal steam pressure of 35 pounds per square inch. The size box temperature is maintained at 180° F. and the squeeze roll is held at a total pressure of 1200 pounds. The sized warp is observed for slasher performance and tested for weaving performance.

The sized yarn having an applied total solids of about 10 weight percent based on the weight of the yarn, is cleanly and easily separated at the split rods with little or no shedding. The sizing solution in the size box remains clear and homogeneous throughout the operation and exhibits no tendency to form a surface skin. The sized yarn is subsequently woven on commercial looms. The looms operate at a high weaving efficiency with very few warp stops.

EXAMPLE 2

Example 1 is repeated except that 0.8 mole (i.e. 40.5% neutralization) of sodium hydroxide is reacted per mole of SMA copolymer and sufficient ammonia is added to bring the pH to 8.4 (i.e. 46% neutralization to a total of 86.5% neutralization). A 4.2% solids solution in water has a viscosity of 204 centipoises at 76° C. and a film of the mixed salt, when dry, exhibits a tensile strength of 3970 p.s.i.

The above two examples serve to demonstrate that the mixed sodium/ammonium salt of SMA has a substantially lower viscosity in aqueous solution than the sodium salt alone and that the mixed salt has the further advantage of increased tensile strength over the polymer reacted with sodium hydroxide alone.

It is further shown that solutions of polymers containing only salts of fixed bases and having viscosities too high for commercial utility can be decreased in viscosity by the addition of a fugitive base and that, after drying, the fugitive base is removed without harm to the physical properties of the size.

EXAMPLE 3

One mole of a 1/1/0.4 interpolymer of styrene maleic anhydride/vinyl acetate is slurried in water and the pH is brought to 5.2 with one mole (i.e., 50% neutralization) of sodium hydroxide. A 5% solids solution is formed thereby which has a viscosity of 11,000 centipoises as measured by a Brookfield Viscometer using a No. 4 spindle at 30 r.p.m. Concentrated aqueous ammonia is added to bring the pH to 6.3 (i.e., 8% neutralization to a total of 58% neutralization) and the viscosity is again measured and found to be 8900 centipoises. Further ammonia is then added to bring the pH to 8.05 (i.e., 19% neutralization to a total of 77% neutralization) and the viscosity is then found to be 580 centipoises.

EXAMPLE 4

One mole of the styrene/maleic anhydride/vinyl acetate interpolymer of Examle 3 is slurried in water and 0.8 mole (i.e., 40% neutralization) sodium hydroxide is added to bring the pH to 4.0. The viscous solution thus formed is divided into three portions, A, B and C. A film is cast of Solution A which, when dry, is found to have a tensile strength of 5000 p.s.i. To Solution B is added an additional 0.7 mole (i.e., 35% neutralization to a total of 75% neutralization) of sodium hydroxide, bringing the pH to 9.0. Again, a film is prepared of the polymer of this solution which, when tested, is found to have a tensile strength of 1150 p.s.i. To Solution C is added sufficient ammonium hydroxide to bring the pH to 9.0 (i.e., 50% neutralization to a total of 90% neutralization). A film of the resin of this solution prepared in the same manner has a tensile strength of 4,150 p.s.i. This example shows that the tensile strength of films prepared from the mixed salts (Solution C) is substantially greater than films prepared from the straight sodium salt taken to an equal pH (Solution B) and is nearly as great as that of films of the interpolymer containing considerably less salt (Solution A) and which, of course, have solution viscosities too high to be workable as textile sizes.

FIG. 1 relates to the 1/1/0.4 styrene/maleic anhydride/vinyl acetate interpolymer of Example 4. Curve ABCD represents a plot of film tensile strength vs. solution pH when adding only sodium hydroxide, i.e., fixed base only, to a high neutralization (see Solutions A & B of Example 3). Curve ABE shows the higher film tensile strengths obtainable by adjustment of pH to point B with sodium hydroxide and then along curve BE by further adjustment of pH with ammonia (see Solution C of Example 3). Curve ABCF shows the relationship by adjustment to point C with sodium hydroxide and then along curve CF with ammonia.

EXAMPLE 5

One mole of an interpolymer of 0.5/1/0.5 styrene/maleic anhydride/vinyl acetate was slurried in water and brought to a pH of 6.2 with 1.12 mole (i.e., 56% neutralization) of sodium hydroxide during which process the interpolymer dissolved. The solids content of the solution was 8.2%. This solution has a viscosity of approximately 6600 centipoises. Sufficient ammonium hydroxide was then added to the solution to bring the pH to 8.9 (i.e., 32% neutralization to a total of 88% neutralization). The viscosity of the mixed salt solution was then found to have been lowered thereby to 305 centipoises.

EXAMPLE 6

Example 1 is repeated except that a non-volatile amine, 2-amino-2-methyl propanol-1 is substituted for the sodium hydroxide and a volatile amine, methylamine, is substituted for the ammonia. Again, the solution viscosity of the mixed salt is substantially less than that of the salt containing only fixed base and yarn sized with the mixed salt can be run on a commercial slasher with a minimum of warp stops.

EXAMPLE 7

(A) 1/1.2 Monobutyl fumarate/styrene
(B) 1/1/0.6 Maleic anhydride/styrene/acrylonitrile
(C) 1/1/0.2 Maleic anhydride/styrene/ethyl acrylate
(D) 1/0.5/0.5 Maleic anhydride/styrene/vinyl methyl ether
(E) 1/0.2/0.8 Maleic anhydride/styrene/isobutylene
(F) 1/0.1/6.0 Maleic anhydride 75% half butyl ester/styrene/vinyl acetate
(G) 1/2.5 Maleic anhydride/styrene Each of interpolymers A through G is 50% neutralized with sodium hydroxide and split into two portions. One portion of each is brought to 80% total neutralization with additional sodium hydroxide and the other portion of each is also brought to 80% total neutralization, but with ammonia. In each instance the mixed salt provides superior film tensile strength at desired working viscosities.

It will be obvious that many variations can be made to the processes and products of this invention without departing from the scope thereof.

What is claimed is:

1. A method for preparing and finishing textile materials which comprises:

treating a textile material with an aqueous solution of a mixed salt of an interpolymer, said interpolymer consisting of:

(1) 1.0 molar proportion of maleic anhydride,
(2) from 0.1 to 3.0 molar proportion of styrene, and
(3) from zero to X molar proportion of vinyl acetate the total of monomers (2) and (3) being at least 1.0 molar proportion; wherein the specific viscosity of the interpolymer determined at 25° C. on a solution of 0.5 gram of interpolymer per deciliter of dimethyl formamide is in the range from about 2 to 8, and wherein
(a) from 10 to 70 percent of the free carboxyl groups of said interpolymer are combined with at least one fixed base selected from the group consisting of non-volatile monobasic amines and alkali metal bases, and
(b) from 5 to 90 percent of the free carboxyl groups of said interpolymer are combined with at least one fugitive base selected from the group consisting of ammonia, ammonium bases and volatile monobasic amines, to provide a workable viscosity for application of the solution to the textile material and such that a total of from 20 to 100 percent of said free carboxyl groups are so combined, and '(B) heating the treated textile material at a temperature high enough to volatilize the fugitive base.

2. The method of claim 1 wherein the specific viscosity of the interpolymer is in the range of from about 3 to 5.

3. The method of claim 1 wherein the fixed base is sodium hydroxide and the fugitive base is ammonia or ammonium hydroxide.

4. The method of claim 1 wherein the interpolymer consists of maleic anhydride and styrene in the molar ratio of from 1:1 to 1:1.4.

5. The method of claim 3 wherein when the fugitive base has been volatilized, the interpolymer salt has a tensile strength greater than about 3000 psi.

* * * * *